US005823166A

United States Patent [19]

Entenmann et al.

[11] Patent Number: 5,823,166

[45] Date of Patent: Oct. 20, 1998

[54] APPARATUS FOR MONITORING THE CYLINDERS OF A MULTI-CYLINDER INTERNAL COMBUSTION ENGINE

[75] Inventors: Robert Entenmann, Benningen; Klaus Ries-Müller, Rappenau, both of Germany

[73] Assignee: Robert Bosch GmbH, Stuttgart, Germany

[21] Appl. No.: 776,707

[22] PCT Filed: Jun. 5, 1996

[86] PCT No.: PCT/DE96/00988

§ 371 Date: Feb. 3, 1997

§ 102(e) Date: Feb. 3, 1997

[87] PCT Pub. No.: WO96/41938

PCT Pub. Date: Dec. 27, 1996

[30] Foreign Application Priority Data

Jun. 10, 1995 [DE] Germany ..... 195 21 277.0

[51] Int. Cl.[6] ..... F02D 41/34

[52] U.S. Cl. ..... 123/414; 73/117.3; 123/419; 123/436; 123/479; 701/111

[58] Field of Search ..... 123/414, 419, 123/436, 479; 73/116, 117.3; 701/104, 105, 111

[56] References Cited

U.S. PATENT DOCUMENTS

| | | | |
|---|---|---|---|
| 4,616,617 | 10/1986 | Geiger et al. | 123/436 |
| 5,329,904 | 7/1994 | Kokubo et al. | 123/414 |
| 5,377,537 | 1/1995 | James | 73/117.3 |
| 5,447,143 | 9/1995 | Ott et al. | 123/612 |

FOREIGN PATENT DOCUMENTS

| | | |
|---|---|---|
| 684376 | 11/1995 | European Pat. Off. . |
| 4122786 | 1/1992 | Germany . |

OTHER PUBLICATIONS

"Patent Abstracts of Japan", vol. 9, No. 198 (M–404), Abstract of JP–60–62665, Aug. 1985.

*Primary Examiner*—Tony M. Argenbright
*Attorney, Agent, or Firm*—Michael J. Striker

[57] ABSTRACT

An apparatus for cylinder recognition in an internal combustion engine is described, in which the individual-cylinder rpm fluctuations or variables dependent on them are first stored in memory and then, when the engine is restarted, compared with the rpm fluctuations that result at that time. From the results of the comparison obtained, a cylinder recognition can be performed. Particularly in conjunction with engines in which engine roughness detection is performed, the cylinder recognition can be done on the basis of adaptation values for the engine roughness detection.

9 Claims, 2 Drawing Sheets

APPARATUS FOR MONITORING THE CYLINDERS OF A MULTI-CYLINDER INTERNAL COMBUSTION ENGINE

BACKGROUND OF THE INVENTION

The invention is based on an apparatus for recognizing the cylinders in a multi-cylinder internal combustion engines.

In multi-cylinder internal combustion engines with a crankshaft and a camshaft, the engine control unit, as a function of the detected position of the crankshaft or camshaft, calculates the instant at which fuel is to be injected for which cylinder, and when ignition is to be tripped in which cylinder. It is conventional to ascertain the angular position of the crankshaft with the aid of a sensor that scans the crankshaft, or a disk connected to it, with a characteristic surface, for instance with many identical angle markers and one reference marker.

Since during one operating cycle the crankshaft rotates twice while the camshaft rotates only once, the phase relationship of the engine cannot be determined unambiguously from the crankshaft sensor signal alone; it is therefore usual to ascertain the camshaft position as well, with the aid of its own sensor, a so-called phase sensor, with a single marker, for instance, on one of the disks associated with the camshaft, which when this marker moves past the sensor generates a voltage pulse in the sensor.

With the aid of such an arrangement, which is described for instance in German Published, Unexamined Patent Application DE-OS 42 30 616, synchronization between the crankshaft and camshaft can be accomplished in a four-stroke internal combustion engine; it is then possible, by evaluating the two signals of the crankshaft and camshaft sensor, to perform an unambiguous cylinder recognition.

An apparatus for cylinder recognition in multi-cylinder internal combustion engines that does not require its own phase sensor is known from Published, Unexamined German Patent Application DE-OS 41 22 786. In this apparatus, after the engine is started, injections into a cylinder are tripped at certain angular positions; initially, no notice is taken as to whether the crankshaft is in its first or in its second revolution in one operating cycle. The reaction of the engine to this injection, or in other words the change in rpm resulting from the injection, is observed, and as a function of the rpm change it is learned which revolution the crankshaft is currently involved in, and whether the injection was done at the correct rotary angle.

SUMMARY OF THE INVENTION

In keeping with these objects, one feature of present invention resides, briefly stated, in an apparatus for cylinder recognition in an internal combustion engine, which is designed so that after the engine is turned on, the course of the rpm or a variable dependent on this course, is ascertained over at least one operating cycle of the engine and stored in the memory, and the next time the engine is turned on, on the rpm course, is ascertained again and compared with the memorized rpm course, for detecting cylinder-characteristic rpm fluctuations and therefore for cylinder identification.

The apparatus according to the invention for cylinder recognition in a multi-cylinder internal combustion engine, has the advantage that no phase signal is needed for cylinder recognition, and that it is possible not only to detect which revolution the crankshaft is involved in at that moment but also that an unambiguous cylinder recognition is possible directly.

These advantages are attained by performing a very precise analysis of the course of rpm, and by detecting fluctuations in engine rpm and individual cylinder rpm, even in normal operation, and using them for unambiguous cylinder identification.

It is especially advantageous that for each internal combustion engine, a cylinder-specific rpm distribution can be stored in a memory, and by comparing the measured rpm distribution with the stored rpm distribution, it can be learned immediately which cylinder is at its top dead center at that moment.

It is also advantageous that the apparatus according to the invention can also be used in combination with rundown detection and can then be used to monitor the current phase relation ascertained from the memorized phase relation. The apparatus according to the invention can also be used in conjunction with a conventional system with a phase sensor, so that safer emergency operation can be achieved in the event of a phase sensor failure.

BRIEF DESCRIPTION OF THE DRAWING

One exemplary embodiment of the invention is shown in the drawing and will be described in further detail in the ensuing description. Individually.

DESCRIPTION OF THE PREFERRED EMBODIMENT

Figure 1:
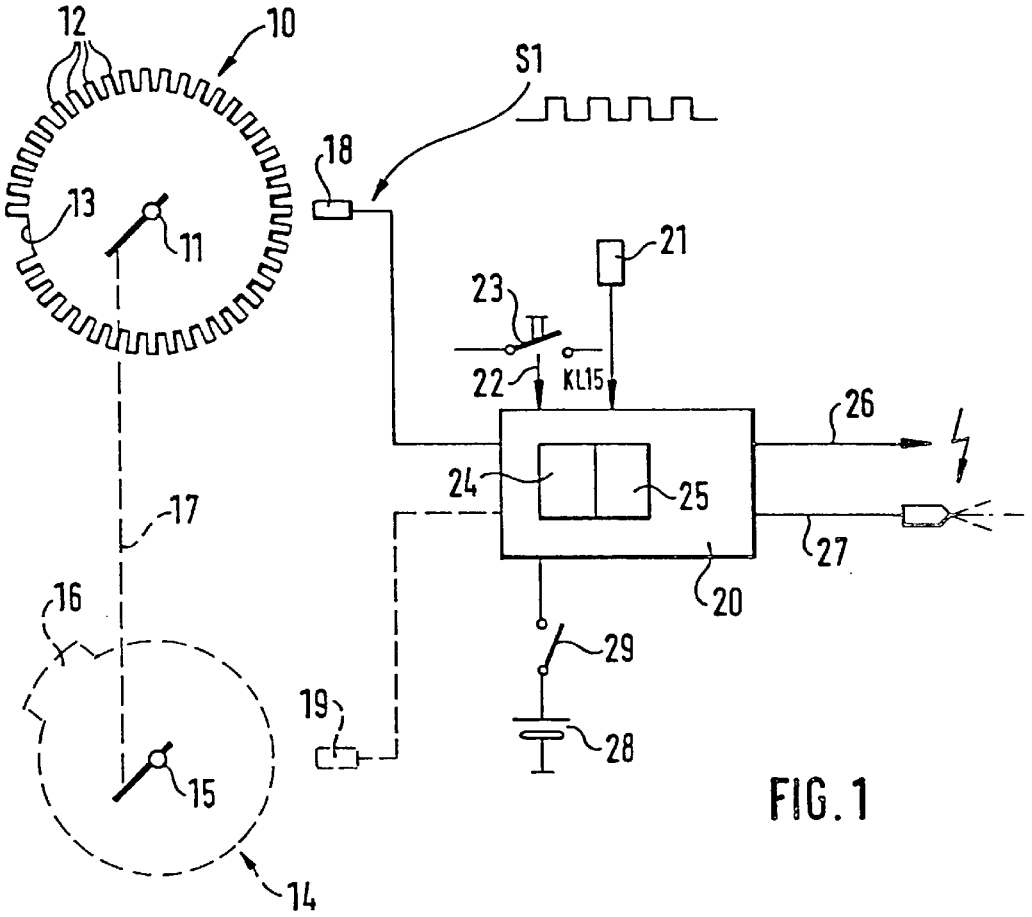
FIG. 1 shows the components of an internal combustion engine required for explanation of the invention.

FIG. 1 schematically shows the components of an internal combustion engine required for comprehension of the invention. This drawing is known for instance from Published, Unexamined German Patent Application DE-OS 42 30 616. In it, specifically, reference numeral 10 indicates a transducer disk, which is rigidly connected to the crankshaft 11 of the engine and has many identical angle markers 12 on its circumference. Provided along with these identical angle markers 12 is one reference marker 13, for instance embodied by the omission of two angle markers.

The camshaft is identified by reference numeral 15. It rotates at half the rpm of the engine and is driven by the crankshaft; this drive is symbolized by the connecting line 17. In conventional systems, a disk 14 that has an angle marker 16, with the aid of which a phase signal is to be generated, is connected to the camshaft 15. This disk 14, the marker 16, and the associated camshaft sensor 19 can all be omitted, with the aid of the apparatus of the invention. If the apparatus claimed is used in conjunction with a system having a phase sensor, then cylinder recognition is still possible even if the phase sensor or camshaft sensor 19 is defective:

The disk 10 connected to the camshaft 11 is scanned with the aid of a crankshaft sensor 18. The crankshaft sensor 18 furnishes a periodic signal S1, which in the processed state is a rectangular signal with a course that corresponds to the surface of the disk 10.

From the output signal of the crankshaft sensor 18, the rpm of the crankshaft 11 is determined in the control unit 20, by the evaluation of the chronological succession of pulses of the signal S1. A current rpm is obtained from the chronological spacing between identical pulse edges, while a mean rpm can be determined from the so-called segment time. The term segment time means the time that elapses while the crankshaft rotates by a certain angle; this angle (one segment) equals a 720° crankshaft angle, divided by the number of cylinders of the engine. Typically, the segment time is equivalent to the length of time between two ignition, or in other words the length of time until the crankshaft has rotated by 720°, divided by the numeral of cylinders. Arbitrarily longer and shorter segment times are also conceivable, however.

Via various inputs, the control unit 20 receives other input variables, which are required for open- or closed-loop control of the engine and are measured by various sensors not identified in detail here. Via an input 22, an "ignition on" signal is also supplied, which is furnished by the terminal K1.15 of the ignition lock when the ignition switch 23 is closed.

On the output side, the control unit 20, which includes computation and memory means 24, 25 not shown in further detail, makes signals available to engine components designated in further detail for ignition and injection. These signals are output via the outputs 26, 27 of the control unit 20.

The voltage supply to the control unit 20 is accomplished in the usual way with the aid of a battery 28, which is connected to the control unit 20 via a switch 29, both during engine operation and during an afterrunning phase after the engine is turned off.

With the arrangement shown in FIG. 1, the desired cylinder identification can be achieved in a four-stroke engine without camshaft identification, that is, either without a camshaft sensor or with a camshaft sensor that is defective. The prerequisite here is that in an engine as schematically shown in FIG. 1, combustion misfiring recognition takes place (for instance, by evaluating rpm fluctuations or detecting engine roughness). Engine roughness detection is also already known from Published, Unexamined German Patent Application DE-OS 32 31 766.

Figure 2:
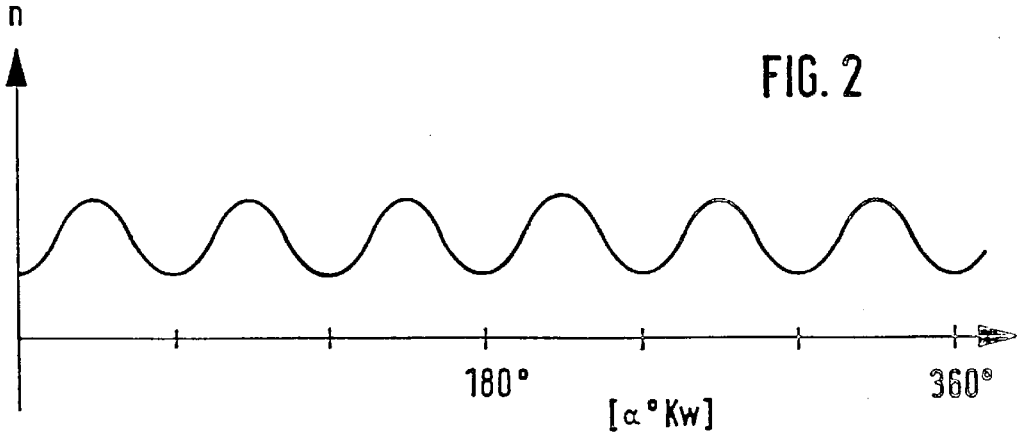
FIG. 2 shows an example of an rpm course over the crankshaft angle for one operating cycle in a 12-cylinder engine.

During normal operation of the internal combustion engine, engine- and cylinder-specific or characteristic rpm fluctuations occur. Such cylinder-characteristic rpm fluctuations are caused for instance by torsional vibrations of the crankshaft in combination with vibration dampers on one side of the crankshaft and a flywheel on the other side of the crankshaft. In engines with high numbers of cylinders, the rpm amplitudes that occur from the torsional vibrations can attain the same order of magnitude as the rpm fluctuations caused by combustion misfiring. In general, the rpm fluctuates as a function of combustion in the operating stroke of the engine. For a 12-cylinder engine, the typical segment time or period length is 60°, referred to the crankshaft angle. In FIG. 2, one such rpm course is schematically plotted over the crankshaft angle $\alpha$.

The aforementioned vibration amplitudes are superimposed on what is theoretically a very uniform rpm course. Since these vibration components are characteristic for a particular engine, cylinder identification can be accomplished unambiguously by evaluating the vibration amplitudes of the individual cylinders. In that case, no phase sensor is necessary, or in a system with a phase transducer, emergency operation can be achieved even if the transducer fails.

Figure 3:
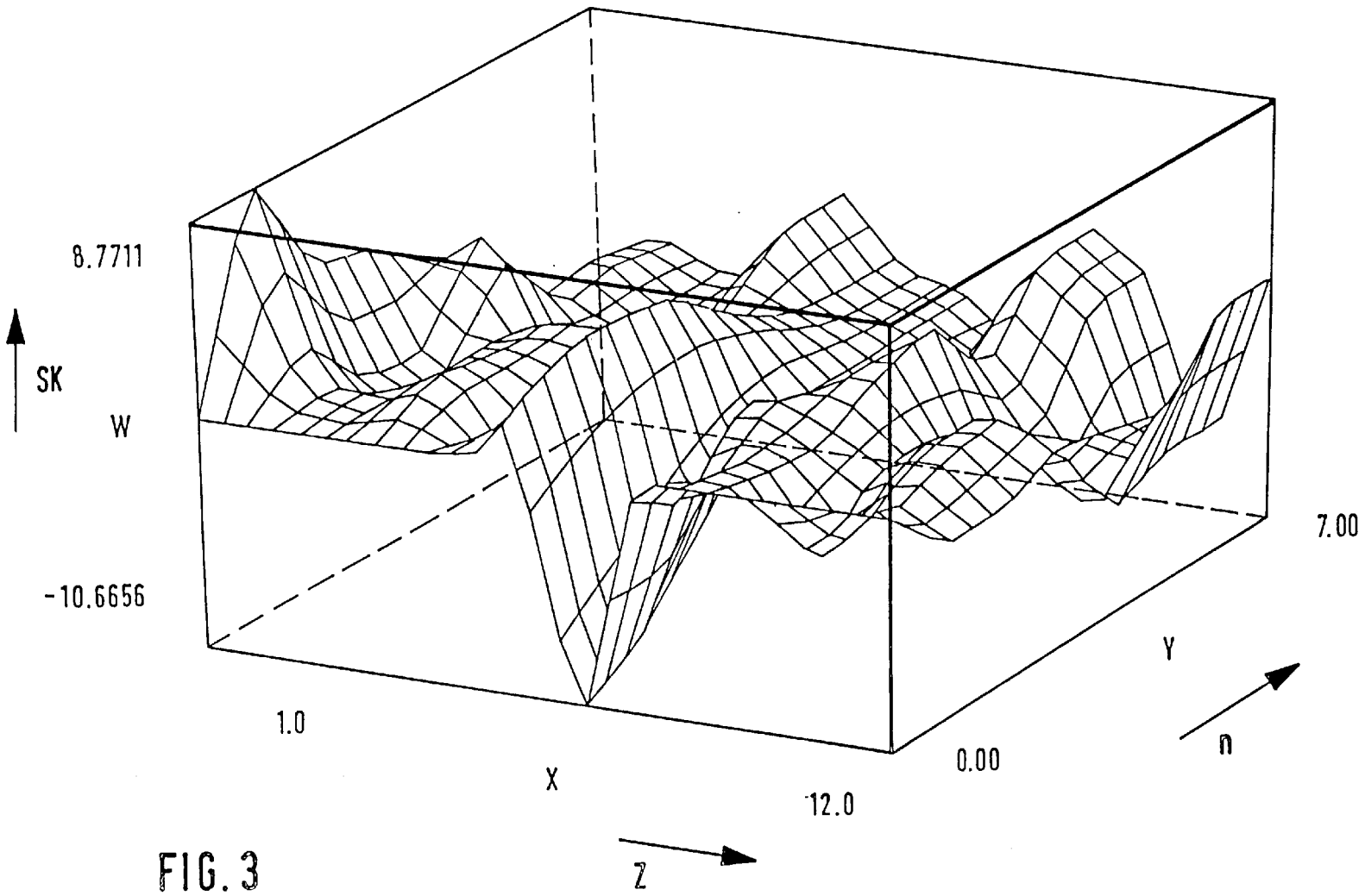
FIG. 3 shows a performance graph for individual-cylinder segment-length correction values for rpm fluctuation compensation in a 12-cylinder engine.

FIG. 3 shows a course of the vibration amplitudes, plotted as segment-time correction values SK for a 60° crankshaft angle as a function of the cylinder number Z and the engine rpm n, taking a 12-cylinder engine as an example.

For cylinder recognition to be possible at all, the individual-cylinder segment-time correction values shown in FIG. 3 are first ascertained. As already noted, these values are needed anyway in conjunction with vibration compensation for combustion misfiring detection (evaluation of rpm fluctuations), and they are stored in a performance graph in the engine control unit. By way of example, the segment-time correction values can be ascertained in that during uniform operation, the individual segment times are measured and the results of measurement are compared with one another. These measurements can be performed at various rpm values and/or load conditions, and the results can be stored in a performance graph. However, it must be assured that no combustion misfiring is occurring. If combustion misfiring is detected, no cylinder recognition is performed, since combustion misfiring can cause irregular rpm courses. During vehicle travel, the individual-cylinder segment-duration correction values are also formed and compared with those stored in memory. The cylinder recognition is derived from the redetected courses.

The cylinder recognition described can be used in the most various engines, but the procedure must be adapted at the onset of injections or ignitions. In an engine with many cylinders, in which the cylinders are arranged in two ranks, the original start can be done with rank injection. If the high-voltage distribution with single-spark coils is initially in repose, starting is then initially done with double-spark operation. This continues until a cylinder identification has taken place.

In further starts in conjunction with rundown detection, which assures that the angle position or phase relation ascertained after the crankshaft has come to a stop will be used as the correct position on restarting, a sequential fuel injection can then be begun immediately.

In original starts or in engines without rundown detection, cylinder recognition can be done in normal operation without major fluctuations in load and rpm, on the condition that no combustion misfiring is occurring. In repeated starts, this kind of procedure can also be employed to check the phase relation stored in memory.

Detecting individual-cylinder rpm amplitudes as a function of load and rpm is also possible under some circumstances. The comparison with corresponding performance graph values can be extended to pattern recognition or to the detection of at least one geometric spacing.

Before the engine is put into operation for the first time, an rpm course typical for that engine, ascertained on a test bench, for instance, can be picked up and stored in a data memory. Based on this memorized rpm course, the cylinder recognition can be done after the engine is turned on.

Once the cylinder identification has been performed, the control unit can initiate steps; for instance, a switchover from group injection to individual injection may be made, and the ignition can be switched over from double-spark to single-spark operation.

We claim:

1. An apparatus for cylinder recognition in an internal combustion engine, comprising a control unit for controlling cyclically repeating operating events selected from the group consisting of ignition events and injection events; a crankshaft sensor outputting signals that allow detection of an ambiguous angular position of a crankshaft referred to an operating stroke of the engine; means for ascertaining an rpm of the crankshaft based on the signals of said crankshaft sensor; and a memory, said ascertaining means ascertaining a first parameter selected from the group consisting of a course of the rpm and a variable dependent on the course of the rpm after the engine is turned over at least one operating cycle of the engine, which parameter is stored in said memory, said ascertaining means ascertaining a next time the engine is turned on the rpm course again; and means for comparing the again ascertained rpm course with the memorized rpm course for detecting cylinder-characteristic rpm fluctuations and hence for cylinder identification.

2. An apparatus as defined in claim 1; and further comprising means for measuring an rpm course typical for the engine before the engine is put into operation for storing in said memory, said comparing means comparing the typical rpm course with a current rpm course for cylinder recognition the next time the engine is turned on.

3. An apparatus as defined in claim 1; and further comprising means for defining cylinder-specific crankshaft angle ranges dependent on a number of cylinders and designated as a segment, said ascertaining means ascertaining for each segment a segment rpm for storing in said memory, said comparing means comparing the stored values of the segment rpm with currently ascertained segment rpms for cylinder recognition.

4. An apparatus as defined in claim 2; and further comprising means for detecting a combustion misfiring, and not performing a cylinder recognition if the combustion misfiring is detected.

5. An apparatus as defined in claim 2; and further comprising means for detecting an engine roughness by ascertaining segment-specific rpm fluctuations, and forming segment correction values and effecting a cylinder recognition on the basis of the segment correction values.

6. An apparatus as defined in claim 5, wherein said means for detecting an engine roughness and forming the segment correction values is formed so that the segment correction values are output in the form of segment-time correction values.

7. An apparatus as defined in claim 2; and further comprising means for taking into account a crankshaft position after a crankshaft has come to a stop on restarting, monitoring as to whether a picked-up crankshaft position and has a cylinder position agree with actually ascertained ones, and if a deviation is found making a correction.

8. An apparatus as defined in claim 2; and further comprising means for initiating a usual injection and ignition programs after a conclusion of the cylinder recognition.

9. An apparatus as defined in claim 2; and further comprising means for detecting failing of a camshaft sensor of the engine, and initiating an emergency operation when the failing of the camshaft sensor is detected so as to effect a cylinder recognition from cylinder-specific rpm fluctuations.

* * * * *